US007055339B2

(12) United States Patent
Hebert

(10) Patent No.: US 7,055,339 B2
(45) Date of Patent: Jun. 6, 2006

(54) INTEGRATED THERMOSYPHON REFRIGERANT HEAT RECOVERY SYSTEM AND HOT WATER HEATER

(75) Inventor: Thomas H. Hebert, Odessa, FL (US)

(73) Assignee: Global Energy Group, Inc., Plano, TX (US)

( * ) Notice: Subject to any disclaimer, the term of this patent is extended or adjusted under 35 U.S.C. 154(b) by 0 days.

(21) Appl. No.: 10/453,839

(22) Filed: Jun. 2, 2003

(65) Prior Publication Data

US 2004/0069006 A1 Apr. 15, 2004

Related U.S. Application Data

(60) Provisional application No. 60/385,075, filed on Jun. 1, 2002.

(51) Int. Cl.
*F25B 27/00* (2006.01)

(52) U.S. Cl. ..... 62/238.1; 62/324.1

(58) Field of Classification Search .... 62/238.1–238.7, 62/324.1

See application file for complete search history.

(56) References Cited

U.S. PATENT DOCUMENTS

| | | | | |
|---|---|---|---|---|
| 4,441,902 | A * | 4/1984 | Jardine | 62/238.6 |
| 4,449,377 | A * | 5/1984 | Draper | 62/324.1 |
| 4,599,870 | A | 7/1986 | Hebert et al. | 62/238.6 |
| 5,689,966 | A * | 11/1997 | Zess et al. | 62/238.6 |
| 6,007,055 | A * | 12/1999 | Schifftner | 261/79.2 |

* cited by examiner

*Primary Examiner*—Melvin Jones
(74) *Attorney, Agent, or Firm*—Burr & Brown

(57) ABSTRACT

A hot water heater with a built in refrigerant heat recovery system is provided. A thermosyphon and Coriolis force powered refrigeration heat recovery unit is integrated into the tank of a conventional gas or electric hot water heater. The heat recovery unit is placed beneath the outer skin of the hot water heater to decrease the number of exterior connections and increase the ease of installation. The use of the Coriolis effect increases the flow rate and thus the efficiency of the heat transfer system.

13 Claims, 4 Drawing Sheets

INTEGRATED THERMOSYPHON REFRIGERANT HEAT RECOVERY SYSTEM AND HOT WATER HEATER

CROSS-REFERENCE TO RELATED APPLICATIONS

This application claims the benefit of provisional application No. 60/385,075, filed Jun. 1, 2002, the disclosure of which is hereby incorporated herein.

FIELD OF THE INVENTION

The present invention is directed toward an improved heat recovery system. More particularly, the present invention is directed toward an improved water heating method that utilizes the thermosyphon and Coriolis effects to produce a more efficient and cost effective water heater.

BACKGROUND OF THE INVENTION

Water heaters and heat pumps are well known devices that are used world wide. Prior art heat recovery devices such as that disclosed in U.S. Pat. No. 4,599,870 to Hebert et al., the disclosure of which is hereby incorporated in its entirety by reference, have been developed to recover the heat produced by a heating, ventilation and air conditioning unit (hereinafter "HVAC unit"). This recovered heat may be utilized to heat water for a variety of purposes such as providing hot water for residential or commercial use. Some of these devices use a pumpless thermosyphon heat transfer system to remove cold water from the tank of the water heater and reintroduce heated water into the tank. The use of these heat recovery units is environmentally friendly and reduces energy consumption.

Unfortunately, prior art heat recovery devices typically require a professional installer to couple the HVAC units to the water heating system. The large number of connections made in such an installation also increase the likelihood that a leak will occur. In addition, the pumping rate of the thermosyphon heat transfer system and, thus, the heat transfer rate of the system, is often less than desired. Therefore, what is needed is an improved heat recovery system that is easier to couple to an existing HVAC system, less likely to leak and has a higher rate of heat transfer.

SUMMARY OF THE INVENTION

A preferred embodiment of the present invention is directed toward a heat recovery system for utilizing excess heat produced by an external heat source such as an air conditioning unit, refrigeration and/or heat pump unit. The system includes a hot water tank for storing a reservoir of hot water. A thermosyphon system removes relatively cold water from a lower region of the hot water tank and introduces relatively hot water into an upper region of the hot water tank. The thermosyphon system is configured to utilize a Coriolis effect to increase the flow rate of the water from the hot water tank through the thermosyphon system. In an especially preferred embodiment, the thermosyphon system utilizes a tube-on-tube heat exchange system. In such a system, a heated fluid is received from the external heat source in a first tube and relatively cold water from the water tank is received in a second tube. The first and second tubes are positioned to contact one another such that heat is transferred from the heated fluid to the relatively cold water. The first and second tubes are wrapped concentrically around the exterior of the hot water tank with the direction of winding such that the Coriolis effect increases the flow rate in the tubes. The thermosyphon system is also preferably incorporated within the outer skin of the water heater such that the water heater only has four external connections; (1) a cold water inlet for receiving cold water from an external water source; (2) a hot water outlet for providing hot water for external use; (3) a heated fluid inlet for receiving heated fluid from the external heat source; and (4) a cooled fluid outlet for returning cooled fluid to the external heat source. Hot water is removed from the hot water tank from the same port that heated water is introduced from the heat transfer unit into the hot water tank. The relatively cold water is removed from the hot water tank through a sediment removal port located at the bottom of the hot water tank.

Another embodiment of the present invention is directed toward a hot water heater that includes a water tank for containing a reservoir of heated water. An external cold water inlet receives relatively cold water from an external water source. An external hot water outlet provides a supply of hot water from the water tank to an external plumping system. An internal cold water outlet removes relatively cold water from a lower region of the water tank. The internal cold water outlet is preferably coupled to a sediment drain of the water heater. A hot fluid inlet receives a relatively hot fluid from an external heated fluid source. A heat transfer unit receives the relatively cold water from the internal cold water outlet and the relatively hot fluid from the hot fluid inlet and transfers heat from the relatively hot fluid to the relatively cold water. The heat transfer unit includes a tube-on-tube heat exchanger that is wrapped around a lower region of the water tank such that a thermosyphon and a Coriolis effect are utilized to remove cold water from the lower region of the water tank and reintroduce heated water into the upper region of the water tank. The heat transfer system is incorporated within an outer skin of the water heater. An internal hot water inlet receives heated water from the heat transfer unit and provides the heated water to an upper region of the water tank. The internal hot water inlet is preferably coupled to the external hot water outlet. The heat transfer unit returns the cooled fluid to the external heat source.

Yet another embodiment of the present invention is directed toward a method of recovering heat produced by an external heat source. In accordance with the method, a heated fluid is provided from the external heat source to a water heater having a hot water tank through a hot fluid inlet. Relatively cold water is removed from a lower region of the hot water tank from a tank outlet that is coupled to a standard tank sediment drain. Heat is transferred from the heated fluid to the relatively cold water with a heat transfer unit to thereby heat the relatively cold water. The step of transferring the heat preferably includes channeling the heated fluid through a first tube and channeling the relatively cold water through a second tube wherein the first tube and the second tune are positioned to be in contact such that heat is transferred from the heated fluid to the relatively cold water. The first tube and the second tube are coiled around the water tank in a manner that results in the corilous effect increasing the flow rate of water through the second tube. The heated water is reintroduced to an upper region of the hot water tank through a heated water tank inlet. The cooled fluid is returned to the external heat source through a cooled fluid outlet. The water heater is configured such that the heat transfer is accomplished within an outer skin of the water heater. Hot water is provided from the water tank for external use through a hot water tank outlet that is coupled to the heated water tank inlet.

The above described embodiments of the present invention provide a number of advantages over the prior art. First, incorporating the heat transfer unit into a standard water heater housing decreases the number of external connections required and, thus, reduces the cost and complexity of installing the system. Second, coiling the heat transfer coils around the water tank in a manner that induces a Coriolis effect in the coils increases the flow rate through the heat transfer unit and increases the efficiency of the heat transfer. Therefore, the present invention represents a substantial improvement upon the prior art.

DETAILED DESCRIPTION OF THE PREFERRED EMBODIMENT

Preferred embodiments of the present invention provide an improved heat recovery system that utilizes the thermosyphon and the Coriolis effects to provide increased performance. The thermosyphon principle is utilized to affect a refrigerant-to-water heat exchange as well as to move water through the heat exchanger. The Coriolis effect is utilized to increase the water pumping rate through the heat exchanger by providing for a counter clockwise direction of water flow above the equator and clockwise direction of water flow below the equator.

Figure 1:
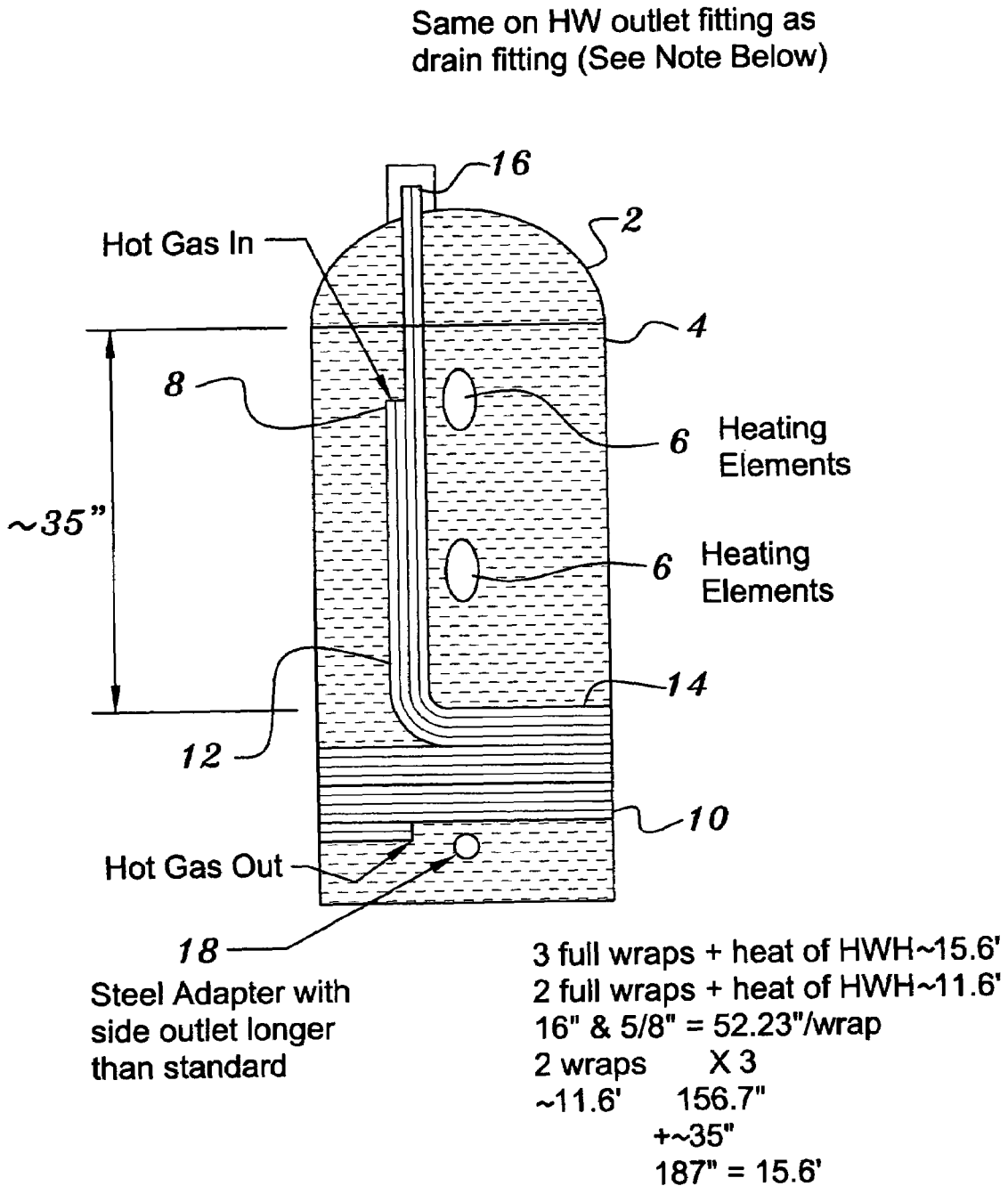
FIG. 1 is schematic representation of a preferred embodiment of the present invention.

Referring to FIG. 1, a schematic representation of a preferred embodiment of the present invention is shown. The invention is preferably contained within a standard water heater housing 2 having a water tank 4 and heating elements 6. The water heater housing 2 receives hot fluid, gas or liquid from an external heat source (not shown) through a hot gas inlet 8. The heat exchange is preferably accomplished by a tube-on-tube (refrigerant tube in contact with water tube in contact with refrigerant tube, etc.) heat exchanger 10 wound on the outside of the conventional hot water heater tank 4. The heat exchanger 10 consists of a gas tube 12 positioned to be in contact with a water tube 14. Heat from the hot gas in the gas tube 12 is transferred from the hot gas to the water in the water tube 14. The heat exchanger 10 is preferably located as low as possible on the tank 4 to create the greatest temperature differential between the relatively cold water drawn into the water tube 14 from a water inlet 18 on a lower region of the tank 4 and the heated water reintroduced from the water tube 14 into an upper region of the tank 4 through a hot water inlet 16. The heat exchanger's 10 length is preferably optimized for a residential sized HVAC, a/c and/or heat pump equipment and residential sized water heaters. However, it will be readily appreciated by those skilled in the art in light of the present disclosure that a similar construction could be utilized for larger water heaters and larger a/c equipment.

A water heater outlet 18 that is typically utilized for tank drainage may also be used to remove relatively cold water from a lower region of the water tank 4. This may be accomplished by having a tee connection for attachment of the water inlet 18 to the heat recovery heat exchanger 10 at the lowest elevation of the heat recovery heat exchanger 10. Similarly, the hot water outlet 16 of the water heater 2 at the top of the hot water heater 2 may have a tee connection for attachment to the hot water outlet 16 of the heat recovery heat exchanger 10. This outlet 16 is advantageously located at the highest elevation of the heat recovery heat exchanger. Connecting the water inlets and outlets of the heat exchanger 10 to preexisting inlet and outlet ports of the water heater tank 4 eliminates the need to provide additional ports on the water tank 4 and, thus, minimizes both the cost of the construction of the water heater and the likelihood of creating a leak.

Figure 2:
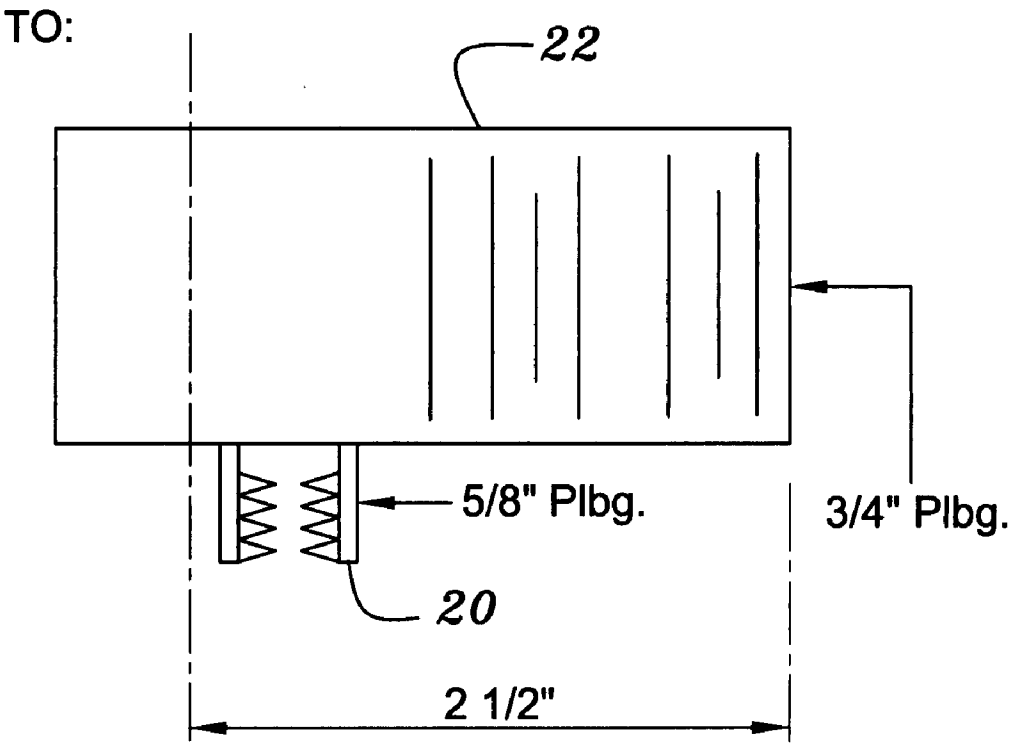
FIGS. 2(*a* and *b*) illustrate a preferred method of coupling the heat exchanger outlet and inlet to the water tank.
Figure 2:
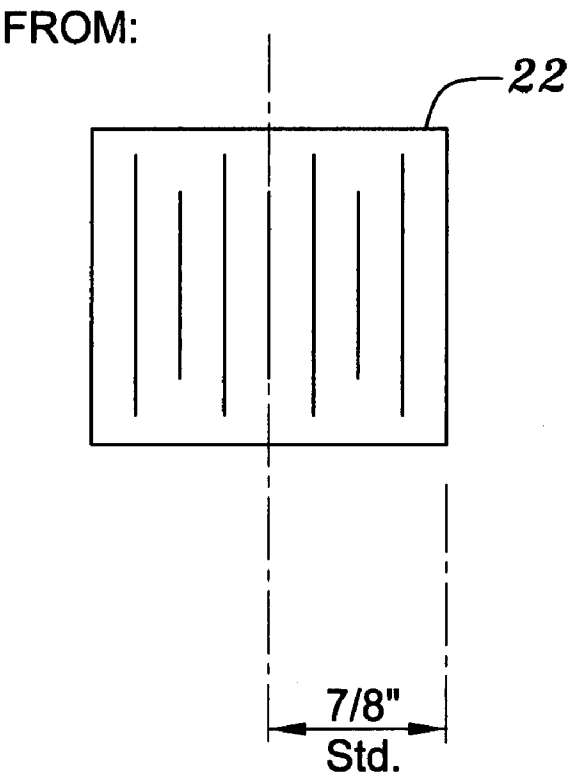

Referring now to FIG. 2, the connections of the heater exchanger inlets and outlets 20 to the standard water heater connections 22 are shown in more detail. Providing these connections inside of the metal skin and insulation covering the water heater reduces the number of external connections and, thus, simplifies the installation of the water heater.

Figure 3:
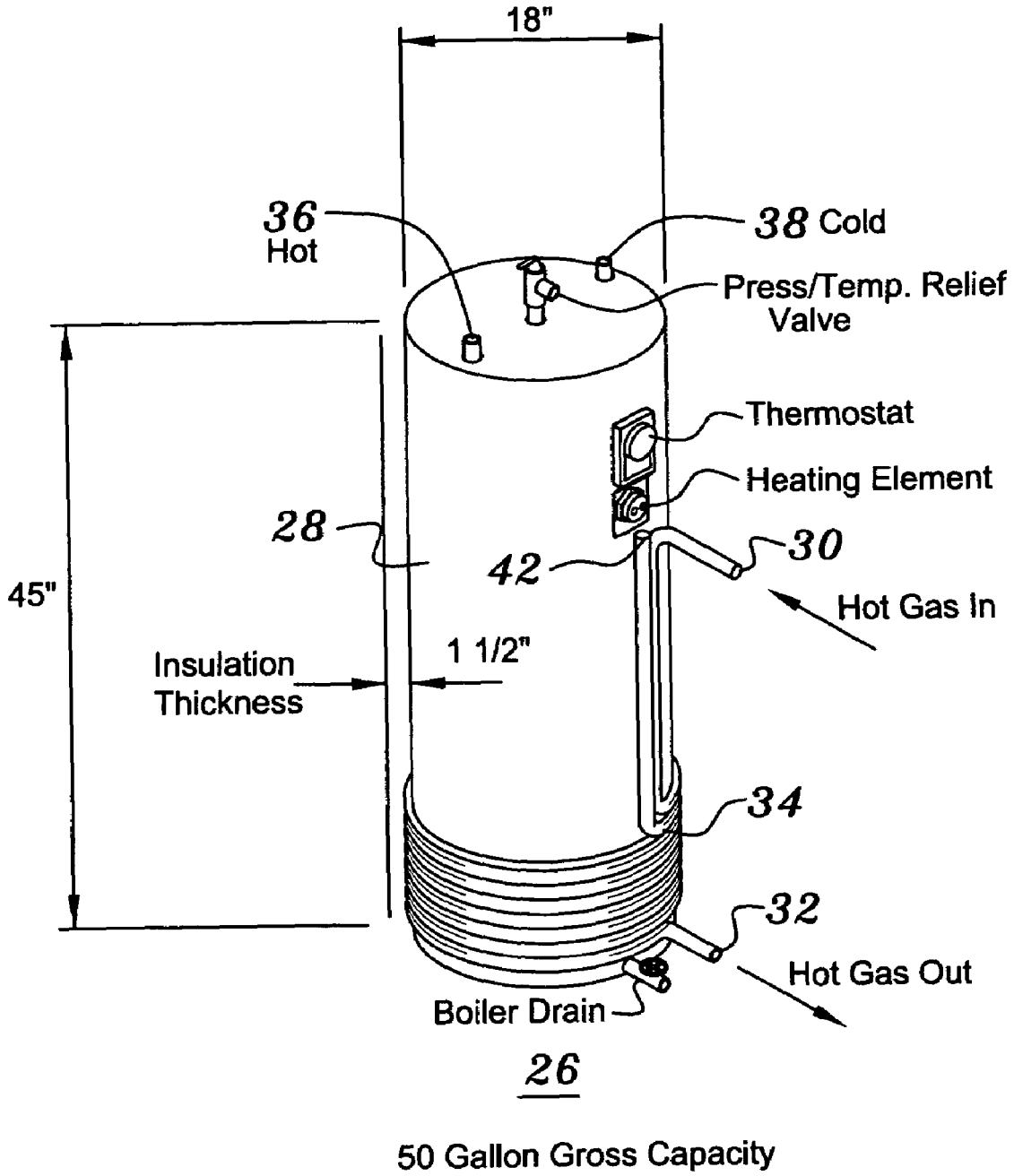
FIG. 3 is a pictorial representation of a preferred embodiment of the present invention.

Referring now to FIG. 3, a preferred embodiment of the present invention is shown. The embodiment of FIG. 3 consists of a hot water heater 26 that has a built-in refrigerant heat recovery system 34 that uses a thermosyphon and a Coriolis effect to pump water and gas through the refrigeration heat recovery exchanger unit 34. The heat exchanger unit 34 is preferably integrated into a conventional hot water heater 26 (either electric or gas) such that no special skills are required to install the water heater 26. The heat exchanger 34 is located beneath the outer skin of the hot water heater 26, with all necessary water connections accomplished in the manufacturing process, leaving only normal water connections to be made during installation. The refrigerant connections 30 and 32 are configured to easily connect the preexisting HVAC system to the heat recovery unit 34.

The water heater 26 is shown with the metal skin and insulation that typically cover the water heater tank 28 removed for ease of illustration. In an actual preferred embodiment, the refrigerant line connections 30 and 32 are stubbed out of the metal skin and insulation covering the standard hot water tank 28. The hot gas inlet 30 to the heat exchanger 34 is preferably positioned at the highest elevation on the water heater tank 28 and the hot gas outlet 32 is preferably positioned at the lowest elevation. The hot water 36 outlet and cold water inlet 38 are positioned as in a standard water heater. The heat exchanger 34 preferably draws relatively cold water from the boiler drain 40 such that no additional holes need to be made in the water heater tank 28. In a similar fashion, heated water from the heat exchanger 34 may be introduced from the heat exchanger 34 to the water heater tank 28 through the hot water outlet 36 or a separate port 42.

The heat exchanger 34 has its tubes coiled around the water heater tank 28 in a manner that induces a Coriolis force in the tubes. If the water heater is designed to be used above the equator, the tubes are coiled around the water heater tank 28 to establish a counter clockwise direction of water flow. If the water heater 28 is designed to be used below the equator, the tubes are coiled in the opposite direction to establish a clockwise direction of water flow. The present inventor has discovered that such an arrangement increases the flow rate of a traditional thermosyphon system by approximately 10%.

Figure 4C:
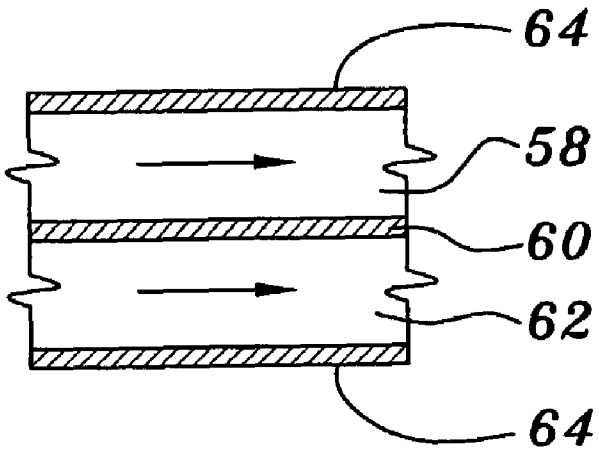
FIGS. 4(*a–c*) are pictorial representations of different types of heat exchangers for use with preferred embodiments of the present invention.
Figure 4B:
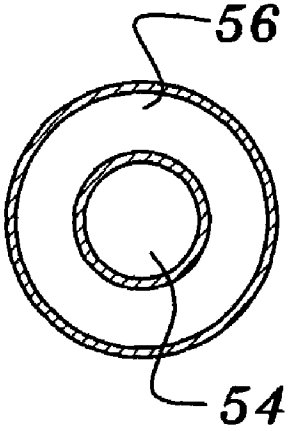
Figure 4A:
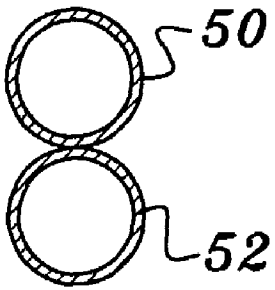

Referring now to FIGS. 4(*a–c*), three preferred heat exchangers 34 for use with the present invention are shown.

FIG. 4(*a*) shows a tube-on-tube heat exchanger. In a tube-on-tube exchanger, the water to be heated flows through a first tube 50 that is placed into contact with a second tube 52. The second tube 52 contains the fluid that is used to heat the water in the first tube 54. FIG. 4(*b*) shows a tube-in-tube heat exchanger that has a first tube 54 that carries the heated fluid surrounded by a second tube 56 that carries the water to be heated. Finally, FIG. 4(*c*) depicts a plate-on-plate system whereby the water to be heated 58 flows across one side of a plate 60 and the fluid 62 that is heating the water 58 flows on the other side of the plate 60. Multiple plates 64 may be used to increase the heat transferring ability of the plate-on-plate system. While the tube-on-tube system is preferred by the present inventor due to its ease of construction and efficiency of transfer, it will be readily appreciated by those skilled in the art in light of the present disclosure that a variety of heat transfer mechanisms could be utilized in conjunction worth the present invention.

It will be understood that the specific embodiments of the invention shown and described herein are exemplary only. Numerous variations, changes, substitutions and equivalents will now occur to those skilled in the art without departing from the spirit and scope of the present invention. Accordingly, it is intended that all subject matter described herein and shown in the accompanying drawings be regarded as illustrative only and not in a limiting sense and that the scope of the invention be solely determined by the appended claims.

I claim:

1. A heat recovery system for utilizing excess heat produced by an external heat source, said system comprising:

a hot water tank for storing a reservoir of hot water;

a thermosyphon system wrapped around and in direct contact with, said hot water tank in a counter-clockwise direction for removing relatively cold water from a lower region of the hot water tank and introducing relatively hot water into an upper region of the hot water tank such that water flows in said system at least in part due to Coriolis effect when the heat recovery system is used in the northern hemisphere of the world to increase a flow rate of the water from the hot water tank through the thermosyphon system.

2. The system of claim 1 wherein the system further comprises a water heater and the thermosyphon system is incorporated within the outerskin of the water heater such that the water heater only has four external connections, said four external connections comprising:

a cold water inlet for receiving cold water from an external water source;

a hot water outlet for providing hot water for external use;

a heated fluid inlet for receiving heated fluid from the external heat source; and a cooled fluid outlet for returning cooled fluid to the external heat source.

3. The system of claim 2 wherein hot water is removed from the hot water tank from the same port that heated water is introduced from the heat transfer unit into the hot water tank.

4. The system of claim 1 wherein the relatively cold water is removed from the hot water tank trough a sediment removal port located on the bottom of the hot water tank.

5. The system of claim 1 wherein the external heat source is an air conditioning unit, refrigeration unit or heat pump unit.

6. The system of claim 1 wherein the thermosyphon system further comprises a tube-on-tube heat exchange system and wherein a heated fluid is received from the external heat source in a first tube and relatively cold water from the water tank is received in a second tube and the first and second tubes are positioned to contact one another such that heat is transferred from the heated fluid to the relatively cold water and wherein the first and second tube are wrapped around the exterior of the hot water tank such that the Coriolis effect increases a flow rate in the second tube.

7. A method of recovering heat produced by an external heat source positioned in the northern hemisphere of the world, said method comprising:

providing a heated fluid from the external heat source to a water heater having a hot water tank through a hot fluid inlet;

removing relatively cold water from a lower region of the hot water tank from a tank outlet;

transferring heat from the heated fluid to the relatively cold water with a heat transfer unit wrapped around, and in direct contact with, said hot water tank in a counter-clockwise direction and thereby heating the relatively cold water;

reintroducing the heated water to an upper region of the hot water tank through a heated water tank inlet; and returning the cooled fluid to the external heat source through a cooled fluid outlet;

wherein a thermosyphon effect and a Coriolis effect are utilized to remove the relatively cold water from the hot water tank and to reintroduce the heated water into the hot water tank.

8. The method of claim 7 further comprising configuring the water heater such that the heat transfer is accomplished within an outer skin of the water heater.

9. The method of claim 7 wherein the step of transferring the heat further comprises channeling the heated fluid through a first tube and channeling the relatively cold water through a second tube wherein the first tube and the second tube are positioned to be in contact such that heat is transferred from the heated fluid to the relatively cold water.

10. The method of claim 7 wherein the step of transferring the heat further comprises transferring heat from the heated fluid to the relatively cold water through a tube-in-tube heat exchanger.

11. The method of claim 9 further comprising the step of coiling the first tube and the second tube around the water tank in a manner that results in the Coriolis effect increasing the flow rate of water through the tubes.

12. The method of claim 7 further comprising providing hot water from the water tank for external use through a hot water tank outlet wherein the hot water tank outlet is coupled to the heated waxer tank inlet.

13. The method of claim 7 wherein the step of removing relatively cold water from the water tank further comprises removing relatively cold water from the water tank from a tank sediment drain.

* * * * *

UNITED STATES PATENT AND TRADEMARK OFFICE

CERTIFICATE OF CORRECTION

PATENT NO. : 7,055,339 B2
APPLICATION NO. : 10/453839
DATED : June 6, 2006
INVENTOR(S) : Thomas H. Hebert It is certified that error appears in the above-identified patent and that said Letters Patent is hereby corrected as shown below:

Column 5

*Line 33*: please add --,-- after "around"

*Line 60*: please change "trough" to --through--

Column 6

*Line 55*: please change "waxer" to --water--

Signed and Sealed this

Fifteenth Day of August, 2006

JON W. DUDAS
*Director of the United States Patent and Trademark Office*